US005180049A

United States Patent [19]

Salvagnini

[11] Patent Number: 5,180,049

[45] Date of Patent: Jan. 19, 1993

[54] DEVICE FOR SUPPORTING AND TRANSPORTING A METAL SHEET IN RELATION TO A WORKSTATION AT WHICH THE METAL SHEET IS TO BE PUNCHED AND/OR SHEARED

[75] Inventor: Guido Salvagnini, Sarego, Italy

[73] Assignee: Salvagnini S.p.A., Sarego, Italy

[21] Appl. No.: 779,850

[22] Filed: Oct. 21, 1991

[30] Foreign Application Priority Data

Oct. 22, 1990 [IT] Italy ..... 21819 A/90

[51] Int. Cl.[5] ..... B65G 15/42

[52] U.S. Cl. ..... 198/699.1; 198/721; 83/941; 271/198; 414/20; 414/677

[58] Field of Search ..... 198/699.1, 721, 372; 144/242 D, 245 A, 245 B; 269/21; 83/941; 271/198, 264; 414/18-20, 677

[56] References Cited

U.S. PATENT DOCUMENTS

| | | | |
|---|---|---|---|
| 2,784,835 | 3/1957 | Dixon . | |
| 2,883,172 | 4/1959 | Mitchell | 198/699.1 |
| 3,425,687 | 2/1969 | Williams | 414/20 |
| 3,955,678 | 5/1976 | Moyer | 198/372 |
| 4,213,733 | 7/1980 | De George et al. | 414/677 |
| 4,452,113 | 6/1984 | Pearl | 83/941 |
| 4,685,363 | 8/1987 | Gerber | 83/941 |

FOREIGN PATENT DOCUMENTS

| | | |
|---|---|---|
| 2104841 | 8/1971 | Fed. Rep. of Germany . |
| 2211610 | 9/1973 | Fed. Rep. of Germany . |
| 3616483 | 11/1986 | Fed. Rep. of Germany . |

*Primary Examiner*—Joseph E. Valenza
*Attorney, Agent, or Firm*—Cushman, Darby & Cushman

[57] ABSTRACT

A metal sheet is supported and transported in relation to a punching and/or shearing station, by supporting the sheet on upwardly projecting flexible bristles, the tips of which define a supporting plane. The bristles have their bases embedded in strips that are removably jammed in grooves defined in a stationary base structure. A conveyor, arranged beside the supporting plane includes a driven, endless belt. The belt has transversally extending bristle bars mounted to it so that, in its carrying run, its upwardly projecting bristles have tips which are effectively coplanar with the stationary supporting surface.

5 Claims, 4 Drawing Sheets

DEVICE FOR SUPPORTING AND TRANSPORTING A METAL SHEET IN RELATION TO A WORKSTATION AT WHICH THE METAL SHEET IS TO BE PUNCHED AND/OR SHEARED

BACKGROUND OF THE INVENTION

The present invention relates to a device for supporting and transporting metal sheets during processing in a punching and/or a shearing machine.

According to the known art, a punching and/or a shearing machine involves in its different embodiments a horizontal plane on which a metal sheet is placed and moved in sequence for the various processing positions, in each of which it undergoes a punching or a shearing operation. Such movement is accomplished through a clamping manipulator which is, movable along two axes that are orthogonal to each other and horizontal.

The sheet generally has large horizontal dimensions and a small thickness and the manipulator's clamps, grasping only one side of it, are thus not in a position of supporting it in the horizontal plane without the contribution of a supporting platform extended over the entire area travelled by the sheet during processing.

Conventionally the supporting platform is provided as metal structure, in general a set of sheet metal panels reinforced by ribs, on whose the upper face there is applied, to diminish friction, a large number of supporting balls. The supporting balls are balls with a diameter ranging from one to two centimeters, which roll on a layer of much smaller balls held in a hemispherical cavity whose radius is equal to the sum of the radius of the main ball and of the diameter of the small balls; the edges of the hemispherical cavity are turned back so that the small balls cannot escape.

The presence of supporting balls on the plane supporting the metal sheet being processed, distributed uniformly over the plane itself, transforms the friction of the sheet on the supporting plane from grazing to rotating, thus solving two problems, by reducing the friction force which the manipulator must overcome and not scoring the sheet's lower face, such scoring being inevitable with the grazing contact.

The reduction in friction between the sheet and the supporting plane is not so important is allowing the increase in the accelerations of the manipulator, that are far more conditions by the inertia of the manipulator and of the sheet than by the friction, but more so, rather, in the accuracy of the positioning of the sheet on the plane. In face, in the step wherein the manipulator decelerates toward the point where the sheet is to be brought to a halt to be punched or sheared, the manipulator itself is deformed in the direction of motion of the inertia forces, which are larger than those of friction. Immediately after being brought to a halt, and before the sheet is punched or sheared, the manipulator must go back to its undeformed shape. It is precisely at this instant that the friction between the sheet and the supporting plane has great importance, because it opposes the return of the manipulator to the undeformed shape and generates inaccuracy in the position of punching or shearing on the sheet.

From this viewpoint the balls have not solved the problem completely, because they still generate some friction, friction that is sufficient to maintain the deformation of the manipulator, which tends to be increasingly lighter and thus less rigid.

The tendency towards increasing the accelerations of the manipulator in modern punching and shearing machines has highlighted another weak point of the supporting balls, which is that between the sheet and the balls a slipping action also takes place in addition to the rolling action and that as a consequence the sheet is scored along its lower face, because the ball's inertia is such as not to be able to accelerate with the sheet due to the effect of the friction's tangential force, which is small, because the sheet's portion bearing on a single ball is small.

If an attempt is made to eliminate this drawback, by reducing the inertia of the supporting balls by decreasing their diameter, the distance between one sphere and the next must perforce also be reduced, to prevent thinner sheets, when bent, from striking the balls with their edges at too high an angle of incidence, and thus, in addition to raising the cost of the balls unit, reducing the weight of the sheet on each ball and the capacity of accelerating its rotation to avoid scoring.

Thus the two problems, to solve which the supporting balls have been adopted on punching and shearing machines, heretofore have had only a partial solution, which becomes all the more unsatisfactory the greater becomes the need to increase the productivity of these machines.

On the other hand, the presence of the supporting balls on the supporting plane generates or complicates other problems such as the interference between the manipulator's clamps and the supporting plane and the evacuation of the punched or sheared sheets.

The lower jaws of the clamps clearly take up a certain space under the sheet's lower face, which rests on the balls. It is thus necessary either to prevent the interference between clamps and balls or to avoid its harmful effects.

Proposed possible solutions to these problems involve the use of flexible clamps or sprung balls, which do not avoid interference but do prevent breakages, or of cam devices which lower the balls when the clamps arrive, thus avoiding interference.

All these solutions have a financial cost that is not negligible and become increasingly critical at higher accelerations and speeds of the manipulator, made possible by the development of electric motors, of the elements for the transmission of motion and of the electronic controls of motion.

In turn, the automatic displacement of the punched or sheared sheets away from the plane on which they have been handled by the manipulator during processing cannot be carried out by the manipulator itself, because the manipulator does not have a sufficient stroke, and requires an additional device.

The ideal solution would be the concordant rotation of all of the balls, upon which the sheet would travel towards the outer part of the supporting plane, but this solution is practically impossible. Another solution would be the sub-division of the supporting plane into a plurality of segments connected together like plates of a plate-type conveyor. The latter, however, would be heavy, slow and not very effective in handling precisely because of the balls' low friction coefficient, which would have difficulty in dragging the sheet along.

Devices have therefore been adopted that are external to the supporting plane, such as handling clamps or batteries of suction cups on a movable carriage, which complicate the machine and make it more expensive.

It is therefore necessary to conclude that the supporting balls do not embody in themselves the solution of the two other accessory problems, i.e., the interference with the claps and the evacuation of the sheets.

Lastly it can be seen that the movement of the sheet on the supporting balls, also due to the non-planarity of the sheet and of the supporting plane, generates noise, because it takes place with a succession of small impacts between bodies connected to resonant structures.

SUMMARY OF THE INVENTION

A first object of the present invention is that of eliminating friction during the step of accurately positioning the sheet in the punching or shearing position.

A second object is that of not scoring the sheet's lower face.

A third object is that of avoiding the addition of devices against the interference between the manipulator's clamps and the supporting plane.

A fourth object is that of eliminating the noise due to the sliding of the sheet over the supporting plane.

A fifth object is that of incorporating in the supporting plane a suitable device for moving punched or sheared sheets toward the outside, that also manages to move the sheets in different positions so as to place them in different piles.

According to the invention such objects are attained by providing a device for supporting and transporting metal sheets during processing in a punching and/or a shearing machine, characterized in that it comprises a supporting plane for the metal sheet formed by a plurality of rows of bristles arranged vertically and with their upper extremities in a same horizontal plane.

To form a stationary supporting plane suitable for cooperating with a manipulator for handling a metal sheet during the punching and/or shearing step, the different rows of bristles are fastened to respective supporting strips constrained to a fixed base.

While to form a movable supporting plane suitable for moving the punched or sheared sheet away, the supporting strips are fastened to respective braces parallel to one another, which braces can be displaced in a direction parallel to themselves along a direction of unloading of the sheet metal.

Independently of the method whereby the bristles are fastened to the supporting structure of the supporting plane, if their resistance to the peak load and their number are such as to support the weight of a sheet of maximum thickness, the simple adoption of the bristles in lieu of the supporting balls attains the first four of the five objects listed above.

In fact, the residual deformation of the manipulator due to the effect of the inertia forces at the instant when it is brought to a halt determines a deviation of the sheet from the required position that is smaller than the deviation of the upper extremity of a bristle from its free position caused by the friction of the sheet. The return of the manipulator to the undeformed shape and the consequent exact positioning of the metal sheet do not thus require a sliding action of the sheet on the bristles' upper extremities, but only an elastic return of the bristles to their free position, such return not opposing any resistance. With this return the first object is attained.

The hardness of the bristles is not such as to scratch a metal surface, and the continuous oscillation of the bristles under the action of the manipulator's clamps and of the sheet prevents the bristles from accumulating abrasive particles. With this hardness and oscillation the second object is attained.

The flexibility of the bristles is such that the lower jaws of the manipulator's clamps displace them during their passage without meeting excessive resistance and without damaging them. With this displacement, lack of resistance and lack of damage, the third object is attained. The bristles' flexibility itself causes the fourth object to be attained.

The friction coefficient between the sheet and the plane constituted by the bristles' upper extremities is ten times higher than the friction coefficient between sheet and supporting balls and this fact, that has a very limited negative effect on the accelerations of the manipulator, because inertia continues to be at a premium on friction, together with the lightness of the bristles, allows the use of the bristles as an integral part of an unloading conveyor. Such a conveyor can constitute that part of the supporting plane of the punching or shearing machine, upon which the manipulator abandons the punched or sheared sheets to take them away from the machine. The high friction and the lightness of the means (belts and pulleys) that can be used for displacing the bristles allow good accelerations of the outgoing sheets.

The conveyor thus conceived has another highly useful feature, in addition to that of being itself an integral part of the supporting plane and of not requiring additional devices for handling the sheets: a metal batten parallel to the rectilinear sections of the belts can move a shut in a direction parallel to that of handling and in one or the other of the two directions, pushing the sheet being handled in the position corresponding to the stacking position in an stacker downstream from the punching or shearing machine. The batten, in fact, interfering to a limited extent with the bristles, which in the meantime are moving along together with the belts, touches the sheet only on one side.

BRIEF DESCRIPTION OF THE DRAWINGS

The features of the present invention shall be made more evident by an embodiment illustrated as a non-limiting example in the enclosed drawings, wherein.

DETAILED DESCRIPTION

Figure 1:
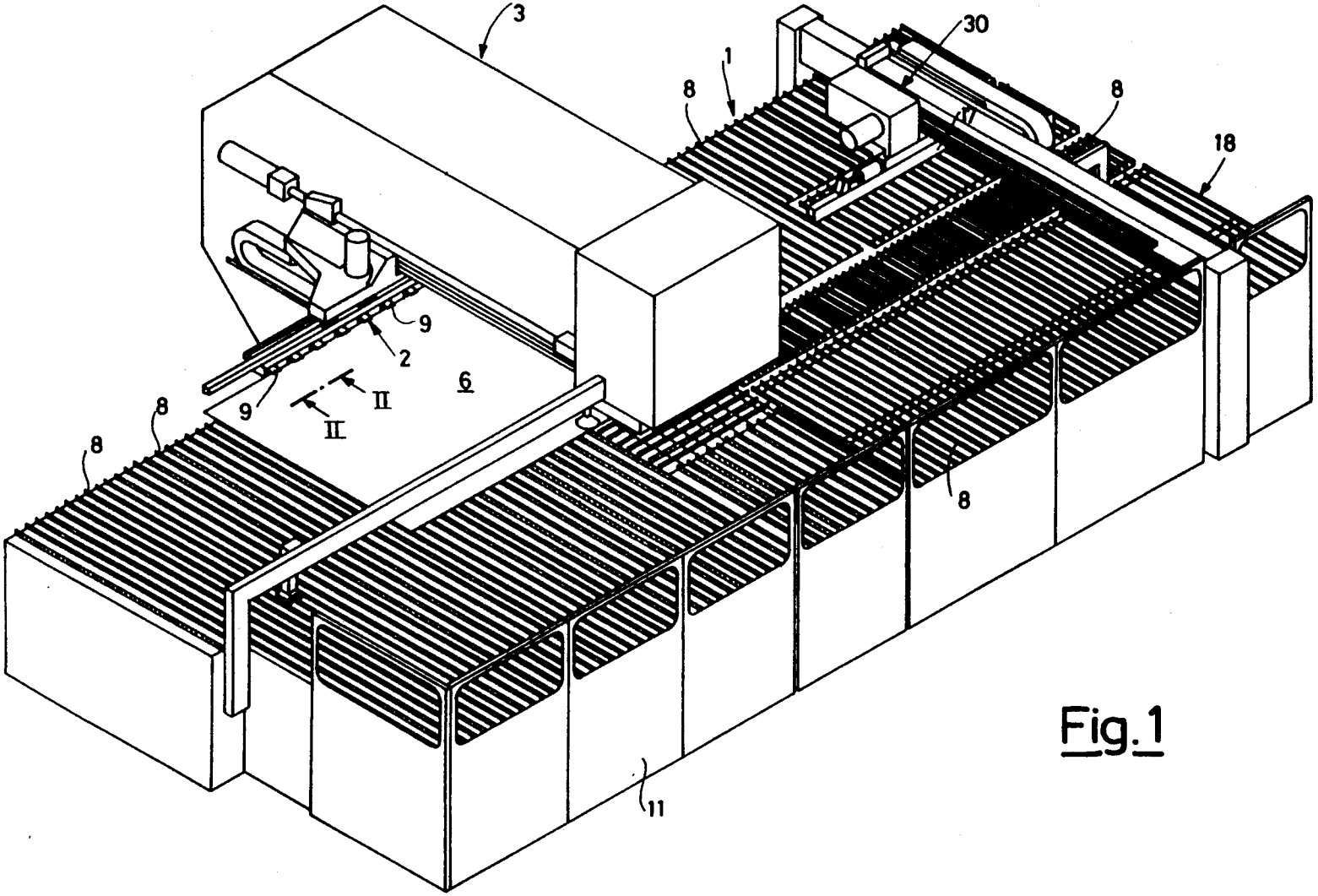
FIG. 1 shows an overall view of a punching and/or shearing machine provided with a supporting plane for a metal sheet, with a manipulator and with a conveyor for the punched or sheared sheet.

With reference to FIG. 1, to a punching and/or shearing machine 3 there are associated, on a base 11, a supporting plane 1 for a metal sheet 6, a manipulator 2 for handling the sheet during the step of punching and/or shearing and, as part of the supporting plane 1, a conveyor 18 for unloading the punched or sheared sheet.

Figure 2:
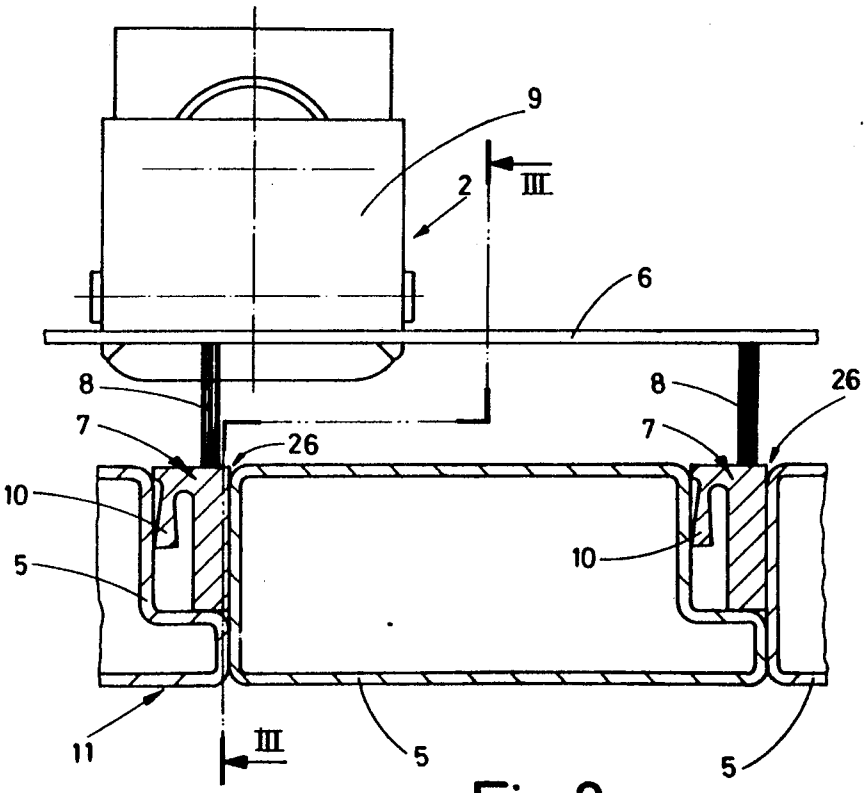
FIG. 2 shows an enlarged detail of the supporting plane, in a sectional view taken along the line II—II of FIG. 1.
Figure 3:
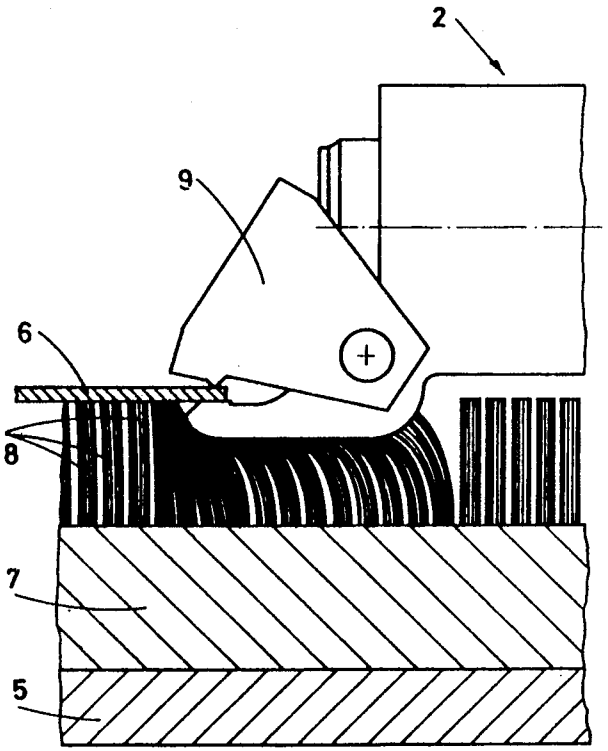
FIG. 3 shows the same detail in a sectional view taken along the line III—III of FIG. 2.

With reference to FIGS. 2 and 3, the base 11 is formed by tubular metal sections 5 placed side by side and welded together, that form longitudinal spaces 26, in which strips 7 of a rigid plastic material are introduced, in which there are inserted, with the traditional technique of brush construction, respective rows of bristle tufts 8 made of synthetic material. The strips 7 can easily be replaced in the spaces 26, where they are lightly jammed, due to the flexibility of their limbs 10.

The manipulator 2 is provided with clamps 9 which, after grasping an edge of the metal sheet 6, move in a direction parallel and/or transversal to the rows of bristle tufts 8, interfering with them without damaging them.

Figure 4:
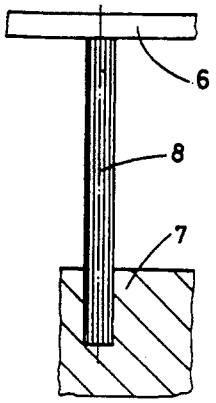
FIGS. 4, 5 and 6 show a tuft of bristles of the supporting plane, in its natural position, at the instant when the manipulator is brought to a halt, and at the instant of punching or shearing, respectively.
Figure 5:
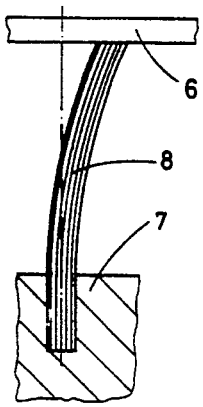
Figure 6:
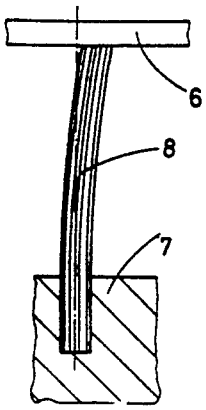

As illustrated in FIGS. 4–6, each bristle tuft 8, jammed in a strip 7 and, in co-operation with many other bristle tufts, supporting the metal sheet 6, can assume all the positions ranging from its natural (i.e., nondeflected) one of FIG. 4, to that of maximum deflection of FIG. 5, determined at the instant when the manipulator is brought to a halt by the friction force that is produced when contact is made between the upper extremities of the bristles 8 and the sheet 6, when the sheet 6 slides with respect to such extremities of the bristles 8. An intermediate position such as that of FIG. 6 is assumed by the bristle tuft 8 at the instant when the sheet 6 is punched or sheared, when the manipulator moving the sheet 6 has recovered its normal shape after being brought to a halt, eliminating the deformations due to the inertia forces. The passage of a certain number of bristle tufts 8 from the position of FIG. 5 to the position of FIG. 6 takers place without the sheet 6 sliding on the upper extremities of the bristles 8 and thus without any resistant forces. This means that the position desired for the sheet 6 is attained without any errors in addition to those of positioning the manipulator on its numerically-controlled axes.

Figure 7:
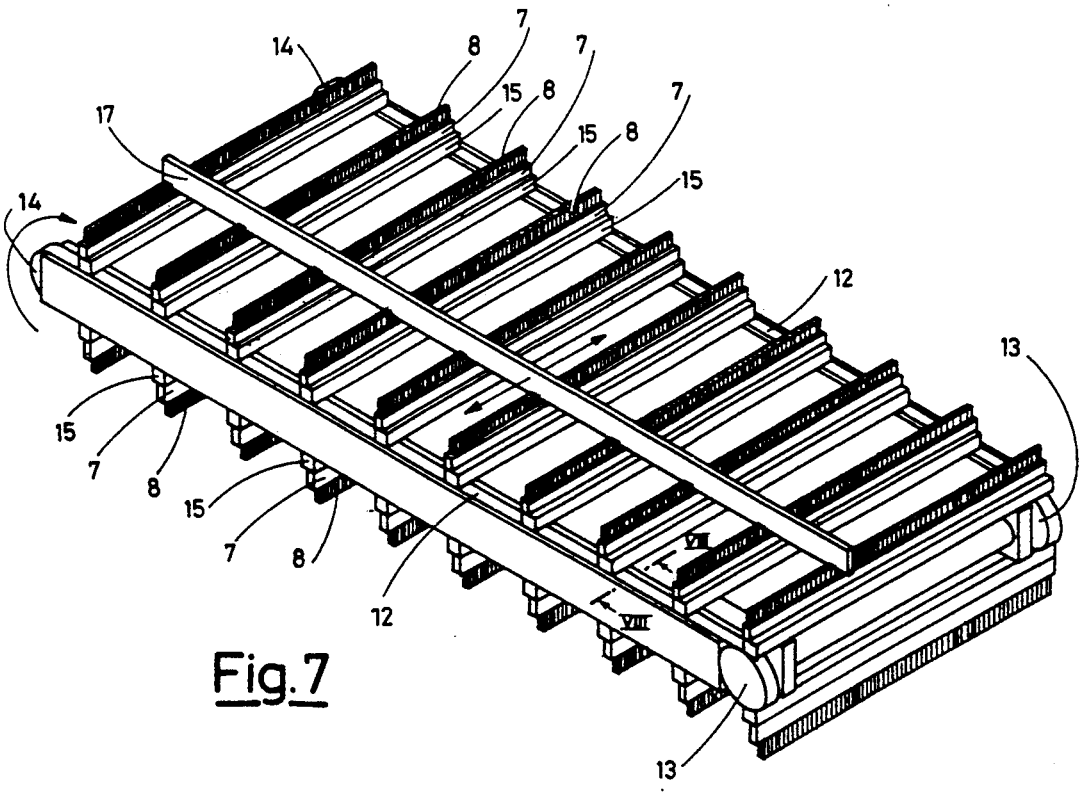
FIG. 7 shows an enlarged detail of the conveyor.
Figure 8:
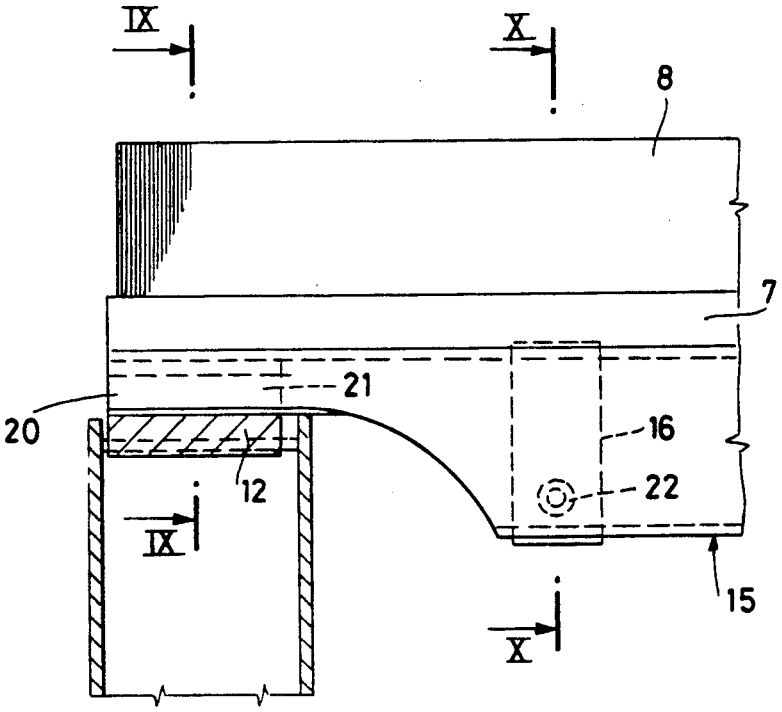
FIG. 8 shows a partial view of a row of bristles, in a sectional view taken along the line VIII—VIII of FIG. 7.
Figure 9:
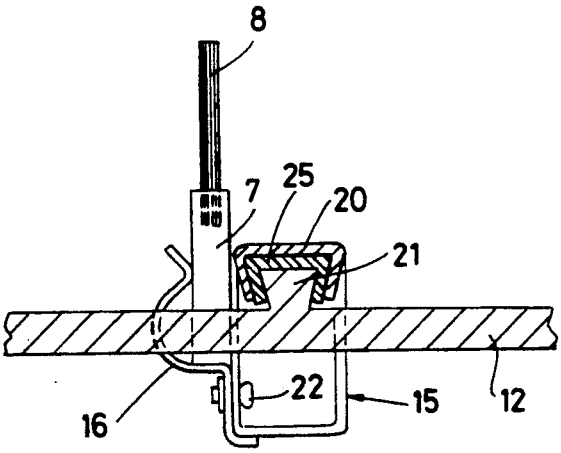
FIGS. 9 and 10 are sectional views taken along the lines IX—IX and X—X of FIG. 8.
Figure 10:
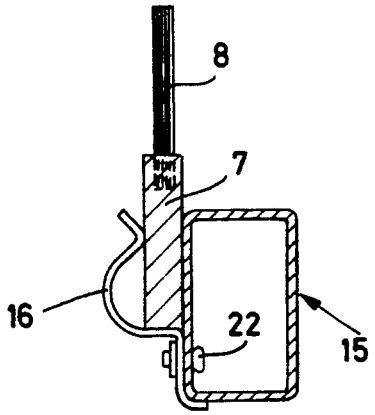

With reference to FIG. 7, the conveyor 18 is formed by two toothed belts 12 wound over two pairs of pulleys 13 and 14, of which the pulleys 13 are driving pulleys. The belts 12 are connected one to the other by a certain number of braces 15 connected to them with their parts 20 coupled, with the interposition of rubber inserts 25, to projections 21 of the belts 12 (FIGS. 8–10).

The strips 7 with the bristle tufts 8 are jammed into the braces 12. A clip 16 fastened with a screw 22 to the brace 15 urges the strip 7 elastically against the wall of the brace 15 itself, and keeps the strip 7 clamped up against the brace 15.

A batten 17 parallel to the belts 12 (FIG. &) is guided and moved by conventional means 30 in the direction parallel to itself and in a horizontal direction parallel to the braces 15 of the conveyor 18, interfering to a limited extent with the upper extremities of the bristles 8 of the conveyor 18. The batten 17 can displace in a direction transversal to the belts 12 the sheet 6 moved by the conveyor 18 and bring the shut 6 into line with the desired stacking position.

During operation, in a manner known in itself, the metal sheet 6, after being positioned on the supporting plane 1, is grasped by the manipulator 2 to be delivered and handled with respect to the punching and/or shearing machine 3. Once the processing operation is over, the sheet 6 is positioned on the conveyor 18 where it is aligned by the batten 17 so that, following the operation of the driving pulleys 13 and consequent movement of the rows of bristles 8 of the conveyor, the sheet 6 is brought to the desired unloading position for possible stacking.

I claim:

1. A device for supporting and transporting a metal sheet in relation to a workstation at which the metal sheet is to be processed by being subjected to at least one of punching and shearing, said device comprising:

a supporting plane for the metal sheet, including:

a plurality of tubular metal sections horizontally arranged side by side, said sections being configured and secured relative to one another so as to define between respective adjoining ones of said sections respective upwardly opening spaces extending lengthwise of the respective sections; and a plurality of bristle bars, each bristle bar comprising a row of bristle tufts having flexible bristles arranged with tips upward and bases downward, for each said row said bases being embedded in a respective supporting strip; each said supporting strip being removably jammingly secured in a respective said upwardly opening space so as to extend lengthwise of the respective sections, with said bristle tufts projecting upwardly so that said tips of said bristles, while undeflected, provide a generally horizontal, upwardly presented though discontinuous supporting surface.

2. The device of claim 1, further comprising:

a conveyor horizontally juxtaposed with said supporting plane, said conveyor including:

an endless conveyor belt entrained about two sets of pulleys so as to have a generally horizontal, upwardly presented carrying run arranged over a return run;

a plurality of bristle bars, each bristle bar comprising a row of bristle tufts having flexible bristles arranged with tips upward and bases downward, for each said row said bases being embedded in a respective supporting strip; and means removably securing each said conveyor belt bristle bar supporting strip to said conveyor belt so as to extend crosswise of said conveyor belt with said bristle tips of said conveyor belt bristle bars projecting away from said conveyor belt;

said bristle tips of said conveyor belt bristle bars, while undeflected, providing while located on said carrying run of said conveyor belt a generally horizontal, upwardly presented though discontinuous supporting surface which is substantially coplanar with said supporting surface of said supporting plane.

3. The device of claim 2, wherein:

said conveyor belt comprises a pair of laterally spaced toothed belts;

each said set of pulleys includes two toothed sprockets meshed with respective ones of said toothed belts, one said set of pulleys being arranged in driving relation to said toothed belts;

braces extending transversally between and secured at opposite ends thereof to said belts; and said securing means removably securing said conveyor belt bristle bar supporting strips to respective ones of said braces.

4. The device of claim 3, further comprising:

a workstation vertically juxtaposed above said supporting plane and arranged to process the metal sheet by subjecting the metal sheet to at least one of punching and shearing; and means for horizontally displacing the metal sheet from said supporting plane onto said carrying run of said conveyor belt, said displacing means including:

a batten arranged to engage an edge of the metal sheet; and means for displacing said batten horizontally while in edgewise contact with the metal sheet, in a direction transverse to said carrying run of said conveyor belt.

5. A device for supporting and transporting a metal sheet in relation to a workstation at which the metal sheet is to be processed by being subjected to at least one of punching and shearing, said device comprising:

a supporting plane for the metal sheet, including:

a stationary base; and a plurality of bristle bars, each bristle bar comprising a row of bristle tufts having flexible bristles arranged with tips upward and bases downward, for each said row said bases being embedded in a respective supporting strip; each said supporting strip being secured to said stationary base, with said bristle tufts projecting upwardly so that said tips f said bristles, while undeflected, provide a generally horizontal, upwardly presented though discontinuous supporting surface;

a conveyor horizontally juxtaposed with said supporting plane, said conveyor including:

an endless conveyor belt entrained about two sets of pulleys so as to have a generally horizontal, upwardly presented carrying run arranged over a return run;

a plurality of bristle bars, each bristle bar comprising a row of bristle tufts having flexible bristles arranged with the tips upward and bases downward, for each said row said bases being embedded in a respective supporting strip; and means removably securing each said conveyor belt bristle bar supporting strip to said conveyor belt so as to extend crosswise of said conveyor belt with said bristle tips of said conveyor belt bristle bars projecting away from said conveyor belt;

said bristle tips of said conveyor belt bristle bars, while undeflected, providing while located on said carrying run of said conveyor belt a generally horizontal, upwardly presented though discontinuous supporting surface which is substantially coplanar with said supporting surface of said supporting plane;

a workstation vertically juxtaposed above said supporting plane and arranged to process the metal sheet by subjecting the metal sheet to at least one of punching and shearing; and means for horizontally displacing the metal sheet from said supporting plane onto said carrying run of said conveyor belt, said displacing means including:

a batten arranged to engage an edge of the metal sheet; and means for displacing said batten horizontally while in edgewise contact with the metal sheet, in a direction transverse to said carrying run of said conveyor belt.

* * * * *